US006683616B1

(12) United States Patent
Yamauchi et al.

(10) Patent No.: US 6,683,616 B1
(45) Date of Patent: Jan. 27, 2004

(54) METHOD AND APPARATUS FOR COLOR ADJUSTMENT OF DISPLAY SCREEN

(75) Inventors: Kazushi Yamauchi, Yamato (JP); Osamu Sato, Zama (JP)

(73) Assignee: International Business Machines Corporation, Armonk, NY (US)

( * ) Notice: Subject to any disclaimer, the term of this patent is extended or adjusted under 35 U.S.C. 154(b) by 371 days.

(21) Appl. No.: 09/614,599

(22) Filed: Jul. 12, 2000

(30) Foreign Application Priority Data

Jul. 15, 1999 (JP) ..... 11-201698

(51) Int. Cl.[7] ..... G09G 5/02

(52) U.S. Cl. ..... 345/589; 345/581; 345/587; 345/593; 345/600; 345/601; 345/549

(58) Field of Search ..... 345/600, 549, 345/589, 581, 597, 593, 601

(56) References Cited

U.S. PATENT DOCUMENTS

| | | | | |
|---|---|---|---|---|
| 4,777,407 A | * | 10/1988 | Takenaka et al. | 313/2.1 |
| 5,298,983 A | * | 3/1994 | Sano | 348/557 |
| 5,300,943 A | * | 4/1994 | Jakobs et al. | 345/1.1 |
| 5,471,629 A | * | 11/1995 | Risch | 707/201 |
| 5,896,642 A | * | 4/1999 | Peker et al. | 148/561 |
| 5,986,642 A | * | 11/1999 | Ueda et al. | 345/600 |
| 6,141,000 A | * | 10/2000 | Martin | 178/18.03 |

FOREIGN PATENT DOCUMENTS

JP 8-27606 3/1996

OTHER PUBLICATIONS

Weinmann,and Lourekas, Photo Shop for Windows and Macintosh, Peachpit Press.*

Robert Cowart, Mastering Windows 3.1, 1992, Sybex, inc., Specila Edition, 154–157.*

* cited by examiner

*Primary Examiner*—Matthew C. Bella
*Assistant Examiner*—Mike Rahmjoo
(74) *Attorney, Agent, or Firm*—Scully, Scott, Murphy & Presser; Robert M. Trepp, Esq.

(57) ABSTRACT

The present invention provides a method and apparatus for color adjustment of a display screen which can provide an interactive user interface which allows a user to perform color adjustment efficiently and effectively.

The color adjustment of the display screen in a color display device, such as LCD, CRT or the like, is performed by displaying a color image without any color adjustment at a certain portion of the display screen, displaying a color image with a color adjustment at another portion of the display screen, and referring to the color image without any color adjustment. And to implement this method for color adjustment, the apparatus is configured so that the color images which have passed the color adjustment block and have their colors adjusted, and the color images which have not passed the color adjustment block and are not subject to the color adjustment can be both displayed on the same display screen.

7 Claims, 12 Drawing Sheets

METHOD AND APPARATUS FOR COLOR ADJUSTMENT OF DISPLAY SCREEN

BACKGROUND OF THE INVENTION

1. Technical Field

The present invention is related to a method and apparatus for color adjustment of a display screen in a color display device. In particular, it is related to a method and apparatus for color adjustment of a display screen which provides an interactive user interface which allows users to perform efficiently and effectively a variety of color adjustments, such as a tint adjustment, a white point adjustment, a blue shift adjustment of achromatic colors or the like in the color display device.

2. Prior Art

In the color display devices, such as LCD (Liquid Crystal Display) and CRT, it is ideal that their colors which can be potentially represented are as close as possible to natural colors (Display Color Fidelity). Furthermore, it is also highly desirable to adjust colors automatically with the device or manually by the user in response to the environment in which the device is placed, such as illumination, so that the most suitable color for the respective environment may be displayed (Color Calibration), and to allow the same color to be displayed independently of the color display device which outputs it (Device Transfer Characteristics), etc. These processes are generically referred to as a color management, and it is an important field a variety of researches and developments of which are conducted as an essential item for the coming and subsequent generations of the color display devices (especially of high performance types). For example, the white point adjustment is an item which is previously recognized to be important, and actually provided in color monitors, etc.

And also, it can be said that the color adjustments, such as a tint control between R and G (from reddish yellow to greenish yellow) as is usual with color TVs, etc., and an adjustment of the color density (from the perfect monochrome to the most dense color), are less important than the white point adjustment in the color monitors of office users, etc., but are still essential items for color adjustment in TV, etc.

When these color adjustments are performed by the user using the color display device, it is important that the adjustments are easy for the user to sensately understand, and effective. Current color monitors and color TVs, etc. satisfy this requirement in a way. That is, if they are provided with an adjusting knob, it has a marking on it so that user may confirm how far the knob is turned (physically) to the right or left from the unadjusted position. Or if the adjustment is performed by means of two switches indicating up and down, and left and right, respectively, with an arrow, a pop-up display representing the current adjustment value with a relative position appears on the screen, and since the position representing the adjustment value on the pop-up display changes in response to user pressing one of the switches, the user can confirm the result of the adjustment. And at this moment, the effect of the adjustment is immediately reflected throughout the entire display screen. This means that the color signals converted by the color adjustment are transmitted to the CRT or the LCD panel, the display section, as they are.

In fact, as mentioned above, the method in which the effect of the color adjustment appears interactively on the display screen in response to the color adjustment, and the user continues to adjust the colors while seeing the changes of the displayed colors, is suited for human senses to some extent. But there is an adaptation (habituation) in the human eye. For example, the case of a tint adjustment (a hue adjustment) is referred to as follows. The tint adjustment is a remnant of the beginning of the appearance of the color TV when the dispersion of the displayed color characteristics between receivers was large, but presently, viewers especially sensitive to a color of a face of a person prefer to utilize this adjustment. Here, assume that a color of a face in one display looks too reddish for a user, and he adjusts the tint toward the green (G) side. In this case, he may have his eyes habituated during the adjustment, and not be aware that he has adjusted the color excessively toward the green (G) side, so that he may feel that the color is too greenish when he sees the display screen under the fixed adjustment value again at a later date. The same may occur in the cases of the white point adjustment and blue shift adjustment of achromatic colors.

These problems are considered to arise due to the lack of a color image to be referenced when adjusting the colors. To avoid these problems, the color adjustment may be performed while referring to a color image whose colors are not adjusted at all. To this end, however, there was a problem that it is necessary to have an environment in which the color adjustment is performed with two color display devices of the same type placed side by side, one used to display a color image whose colors are not adjusted, and the other used to display a color image whose colors are adjusted.

The object of the present invention is to overcome the above-mentioned problems, and to provide a method and apparatus for color adjustment of a display screen which provides an interactive user interface which allows users to perform color adjustment efficiently and effectively.

SUMMARY OF THE INVENTION

The present invention is related to a method for color adjustment of the display screen in the color display device, such as LCD and CRT. The color adjustment is performed by displaying a color image without any color adjustment at a certain portion of the display screen, displaying a color image with a color adjustment at another portion of the display screen, and referring to the color image without any color adjustment.

According to the present invention mentioned above, an interactive user interface which allows users to perform color adjustment efficiently and effectively may be provided by enabling to display the color image under the color adjustment values at that moment, and simultaneously to display in another area on the same display screen a color image whose colors are not adjusted at all, when performing a variety of color adjustments.

In a preferred example of the method for color adjustment of the display screen according to the present invention, the color adjustment is any one of a tint adjustment, a white point adjustment, or a blue shift adjustment of achromatic colors. The display screen is substantially equally divided into top and bottom parts, or into left and right parts, the color image whose colors are not adjusted at all is displayed on one part of the display screen, and simultaneously the color image whose colors are adjusted is displayed on the other part of the display screen. Alternatively, the display screen is divided into multiple display screens, the color image whose colors are not adjusted at all is displayed on one display screen, and simultaneously the color images whose colors are differently adjusted are displayed on the other display screens, respectively. Furthermore, the configuration is adapted to change the colors of the color image whose colors are adjusted, in real time in response to the color adjusting operation by the user. In either case, the present invention may be embodied more efficiently and effectively.

And, the apparatus for color adjustment of the display screen according to the present invention addresses an apparatus for color adjustment in which the color adjustment is performed by means of a block (hereinafter called "a color adjustment block") for delaying by a certain clock cycle (Dca cycle) the digital color data which are synchronized with the pixel clock and successively inputted into it, transforming them, and outputting them in a pipeline manner. In this apparatus for color adjustment, a counter which allows the apparatus to recognize in which row and column within one frame an input color image signal is to be displayed is provided by monitoring and counting synchronous input signals, such as horizontal synchronous signals (HSYNCH) or vertical synchronous signals (VSYNCH), and during a color adjustment period, the counter values are utilized (1) to pass input color signals used to display an area in the display screen through the color adjustment block, and transmit the color signals delayed by the Dca cycle and transformed in the color adjustment block to the later display section, and (2) not to pass input color signals used to display another area in the display screen through the color adjustment block, only delay them by the Dca cycle, and transmit them to the later display section, so that the color image whose colors are adjusted is displayed at a certain portion of the display screen, and the color image whose colors are not adjusted at all is displayed at another portion of the display screen.

According to the apparatus for color adjustment of the present invention as described above, the method for color adjustment of the display screen of the present invention may be implemented by adding a relatively simple configuration. In a preferred example of the apparatus for color adjustment according to the present invention, the switching between the signals of said cases (1) and (2) is performed by MUXs (multiplexers) utilizing said counter values. And at the end of the color adjustment period, the selections of the MUXs are fixed so that the color signals having passed the color adjustment block are transmitted to the display section of the later stage over the whole display area. In either case, the apparatus for color adjustment according to the present invention may be more favorably implemented.

BRIEF DESCRIPTION OF THE DRAWINGS

Preferred embodiments of the present invention will now be described, by way of example only, with reference to the accompanying drawings in which.

DETAILED DESCRIPTION OF THE PREFERRED

Embodiments of the Invention

FIGS. 1 to 4 show an example of the method for color adjustment of the display screen according to the present invention. In the example shown in FIGS. 1 to 4, a case that a face of a person is a target of the color adjustment will be described.

Figure 1:
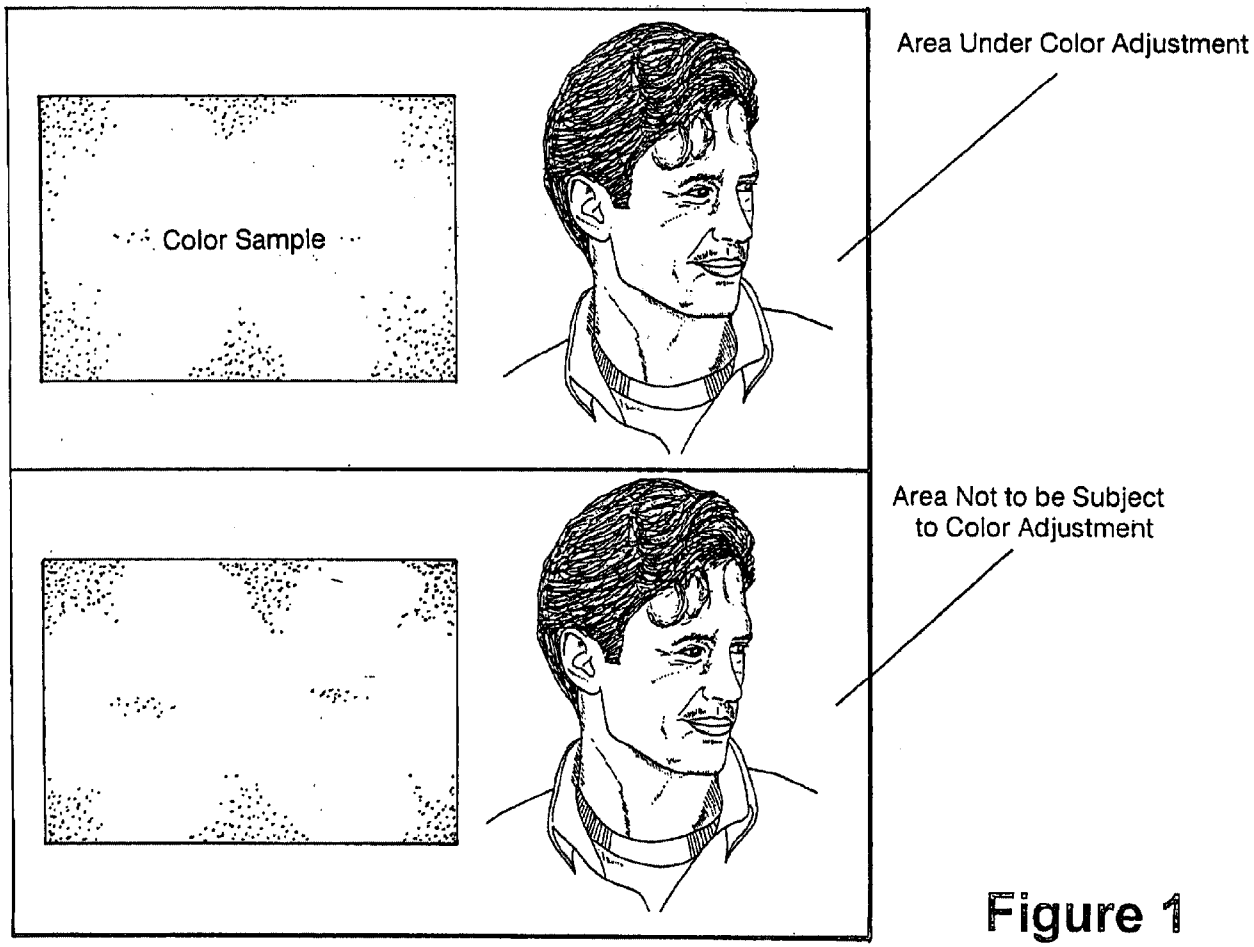
FIG. 1 shows an example of the method for color adjustment of the display screen according to the present invention.

First, in the example shown in FIG. 1, the display screen is equally divided into top and bottom parts. A color image under color adjustment (a static image) is displayed in the top part of the display screen, and a color image whose colors are not adjusted at all (the same image as that of the top part) is displayed in the bottom part of the display screen. In this example, a bar of color samples used in color adjustment is also displayed in each of the areas of the display screen. A user refers to the color image whose colors are not adjusted at all displayed in the bottom part of the display screen, and employs the bar of color samples, to adjust the colors of the color image displayed in the top part of the display screen. Although examples of the color adjustments are not particularly specified, among others a tint adjustment, white point adjustment, and blue shift adjustment of achromatic colors are important.

Figure 2:
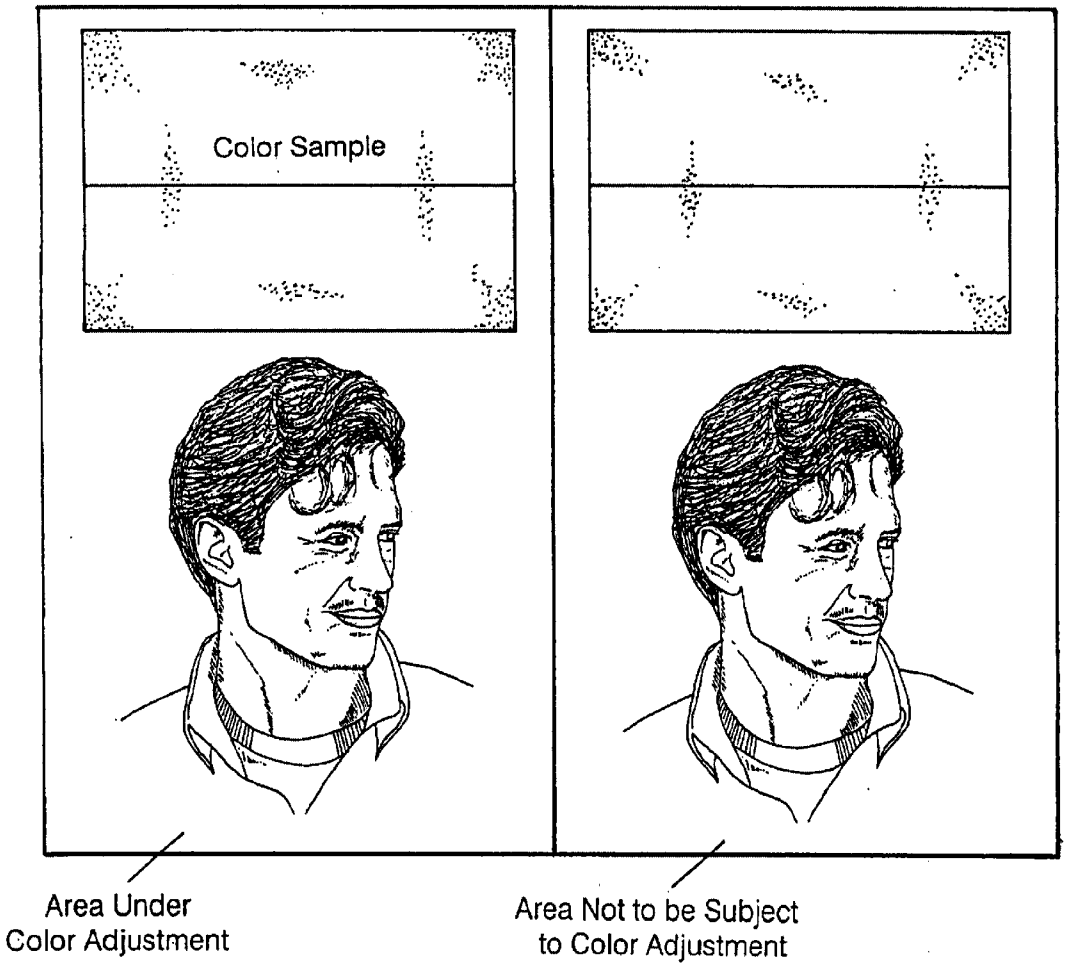
FIG. 2 shows another example of the method for color adjustment of the display screen according to the present invention.

In the example shown in FIG. 2, the display screen is equally divided into left and right parts. A color image under color adjustment is displayed in the left part of the display screen, and a color image whose colors are not adjusted at all is displayed in the right part of the display screen. In this example, as in the example shown in FIG. 1, a bar of color samples used in color adjustment is displayed in each of the areas of the display screen.

Figure 3:
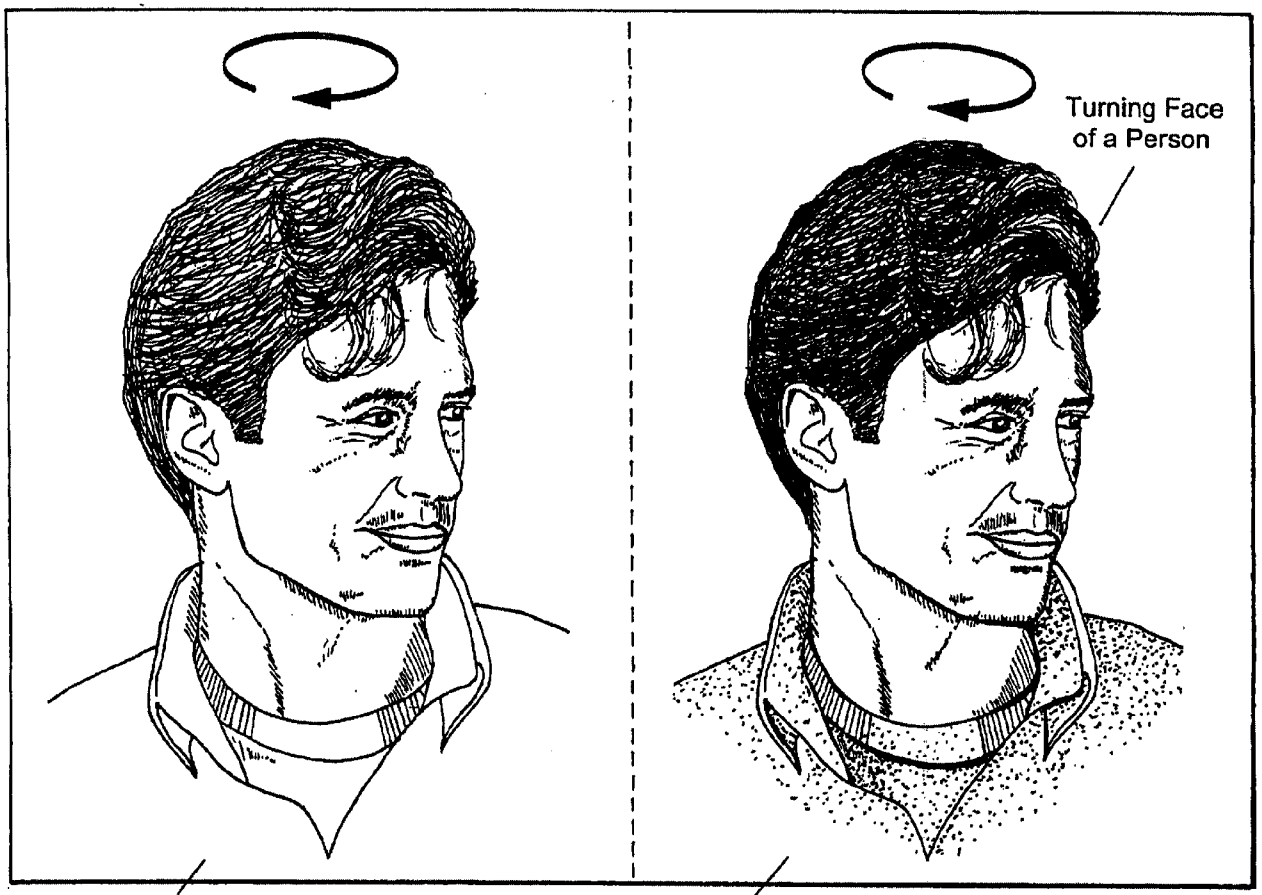
FIG. 3 shows another example of the method for color adjustment of the display screen according to the present invention.

In the example shown in FIG. 3, the display screen is equally divided into left and right parts. A moving image of the color image whose colors are not adjusted at all (in this example, a turning face of a person) is displayed in the left part of the display screen, and a moving image of the color image under color adjustment is displayed in the right part of the display screen. In this example, displaying simultaneously in the left and right parts of the display screen the same moving images of the color images enables to make the best use of the characteristic that the effect of the color adjustment is reflected in real time. In this way, in the case of the moving images, etc., in which the displayed patterns are varied from frame to frame, methods for adjusting a certain color data itself as is usual in the conventional point editor tools, etc., cannot be applied.

Figure 4:
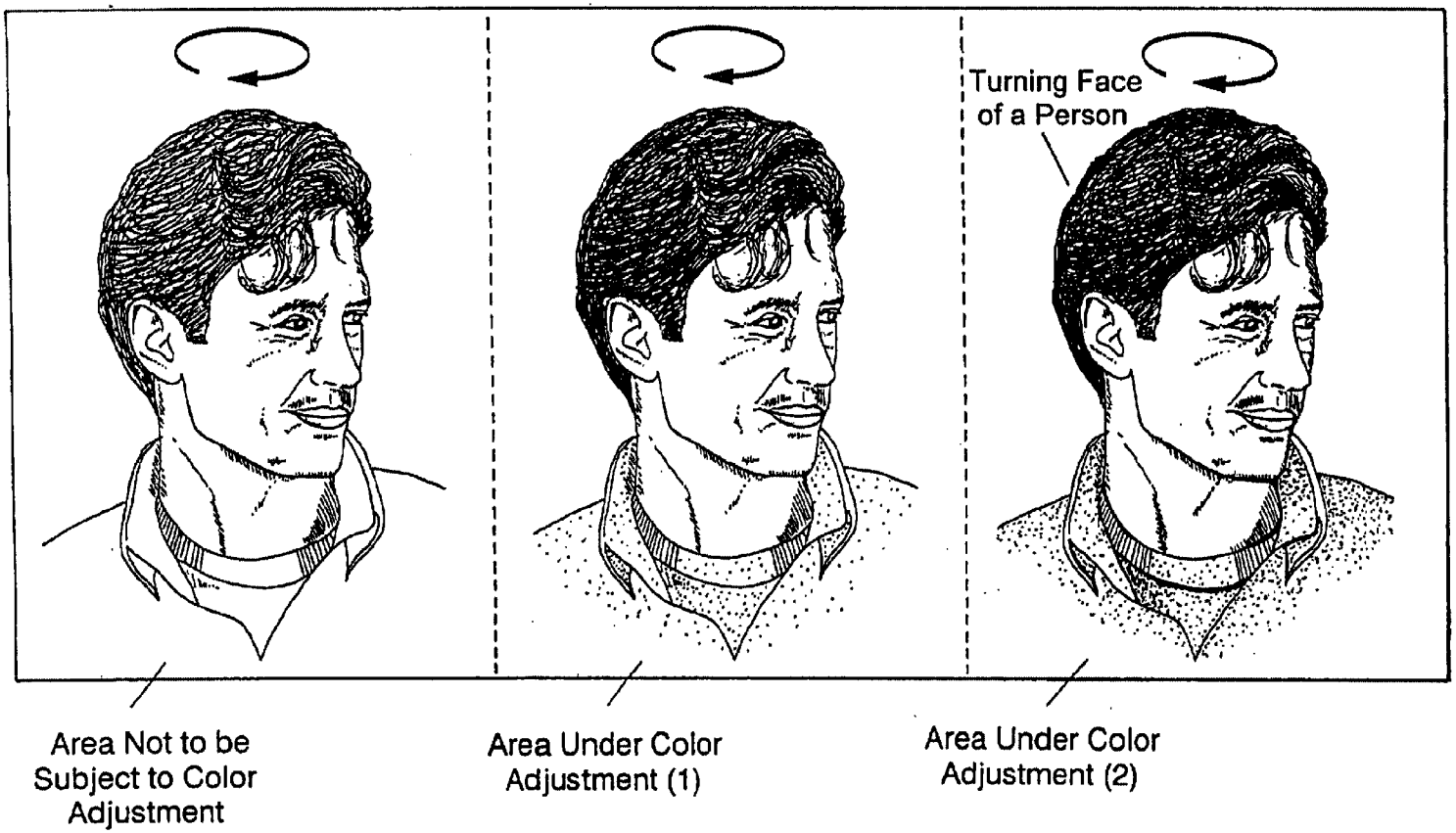
FIG. 4 shows another example of the method for color adjustment of the display screen according to the present invention.

In the example shown in FIG. 4, the display screen is substantially equally divided into three parts side to side. A moving image of the color image whose colors are not adjusted at all (in this example again, a turning face of a person) is displayed in the left part of the display screen, a moving image of the color image under color adjustment (1) (for example, a tint adjustment) is displayed in the middle part of the display screen, and a moving image of the color image under another color adjustment (2) (for example, a white point adjustment) is displayed in the right part of the display screen. In this example again, the same moving image of the color image should be simultaneously displayed in each of the left, middle, and right parts of the display screen. And when adjusting the colors, for example, the moving image of the color image reflecting the effect of the color adjustment (1) in real time is displayed in the middle part of the display screen, and at some point in time, the color adjustment (1) is fixed and displayed. That is, a set value of the color adjustment (1) is maintained, and the effect of this set value on the display is also maintained. Then, from this point of time, the color adjustment (2) is started in the right part, and the moving image of the color image reflecting the effect in real time is displayed in the right part of the display screen. In the example shown in FIGS. 1 through 4, the user operates the color adjustment by means of switches, etc. separately provided.

Figure 5:
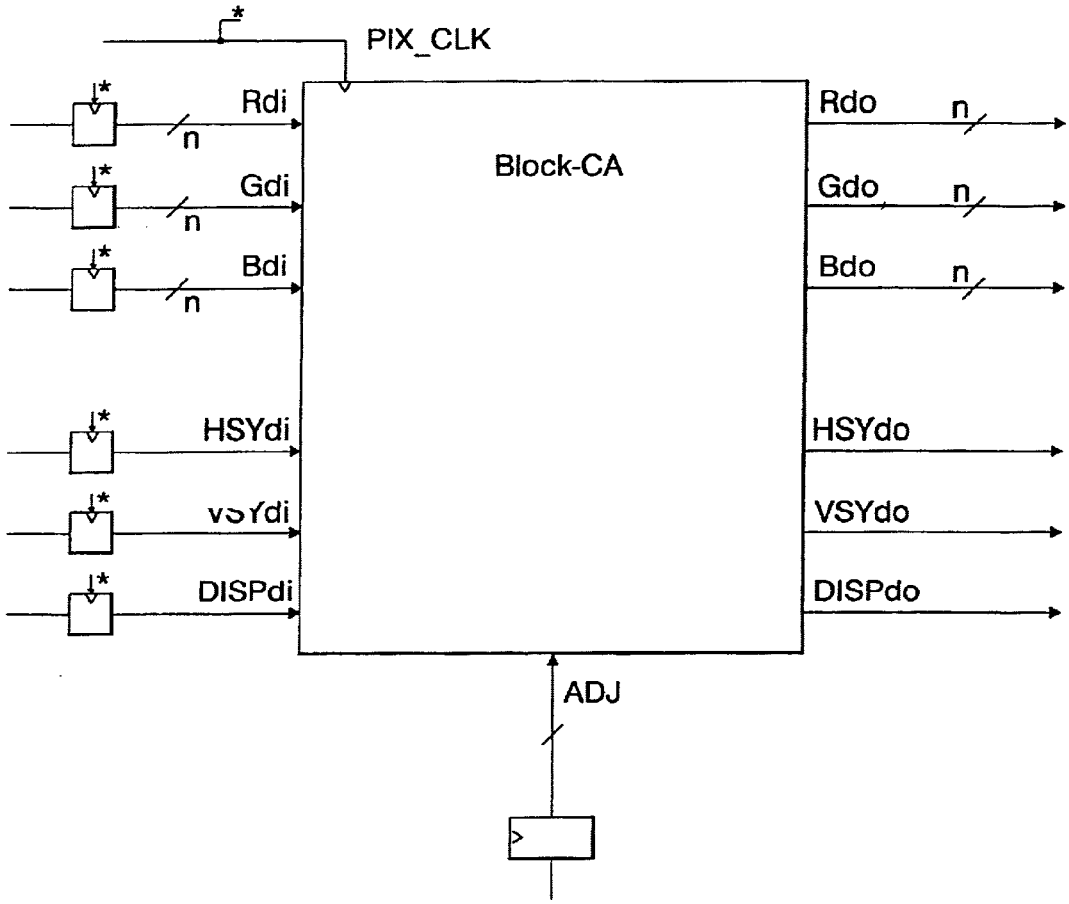
FIG. 5 shows an example of a general configuration of a color adjustment block in an n bits/color digital color display device.
Figure 6:
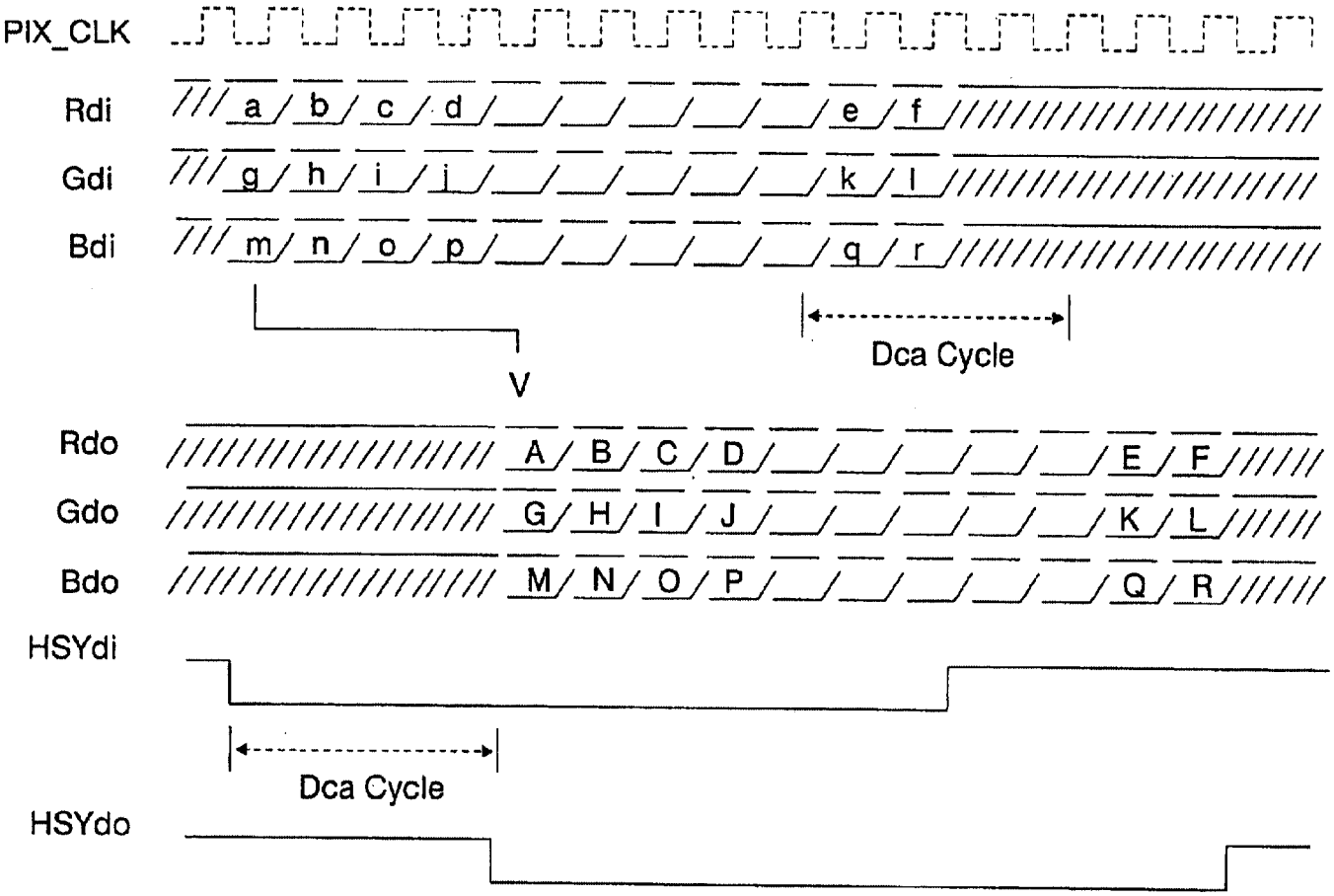
FIG. 6 is an example of a timing diagram representing the relationship between the input and output signals in the example shown in FIG. 5.

The apparatus for implementing the above-mentioned method for color adjustment will now be described. FIG. 5 shows an example of a general configuration of a color adjustment block in an n bits/color digital color display device. In FIG. 5, input bus signals Rdi, Gdi, and Bdi, to the Block-CA, the color adjustment block, carry color data of each of sub-pixels R, G, and B, respectively, which are synchronized with a pixel clock (PIX_CLK), and successively transmitted from a host system. Similarly, HSYdi, VSYdi, and DISPdi are synchronous control signals transmitted from the host system. And, an input bus signal ADJ is an input signal for providing color adjustment values for the Block-CA, the color adjustment block, and is output from latches. The Block-CA refers to the values of ADJ to transform the values of these Rdi, Gdi, and Bdi in each clock phase, delays them by Dca clock cycle, and outputs them in a pipeline manner as signals Rdo, Gdo, and Bdo also synchronized with the pixel clock. On the other hand, the HSYdi, VSYdi, and DISPdi are only delayed by the Dca clock, and outputted as HSYdo, VSYdo, and DISPdo. A timing diagram representing the relationship between the input and output signals is shown in FIG. 6.

Figure 7:
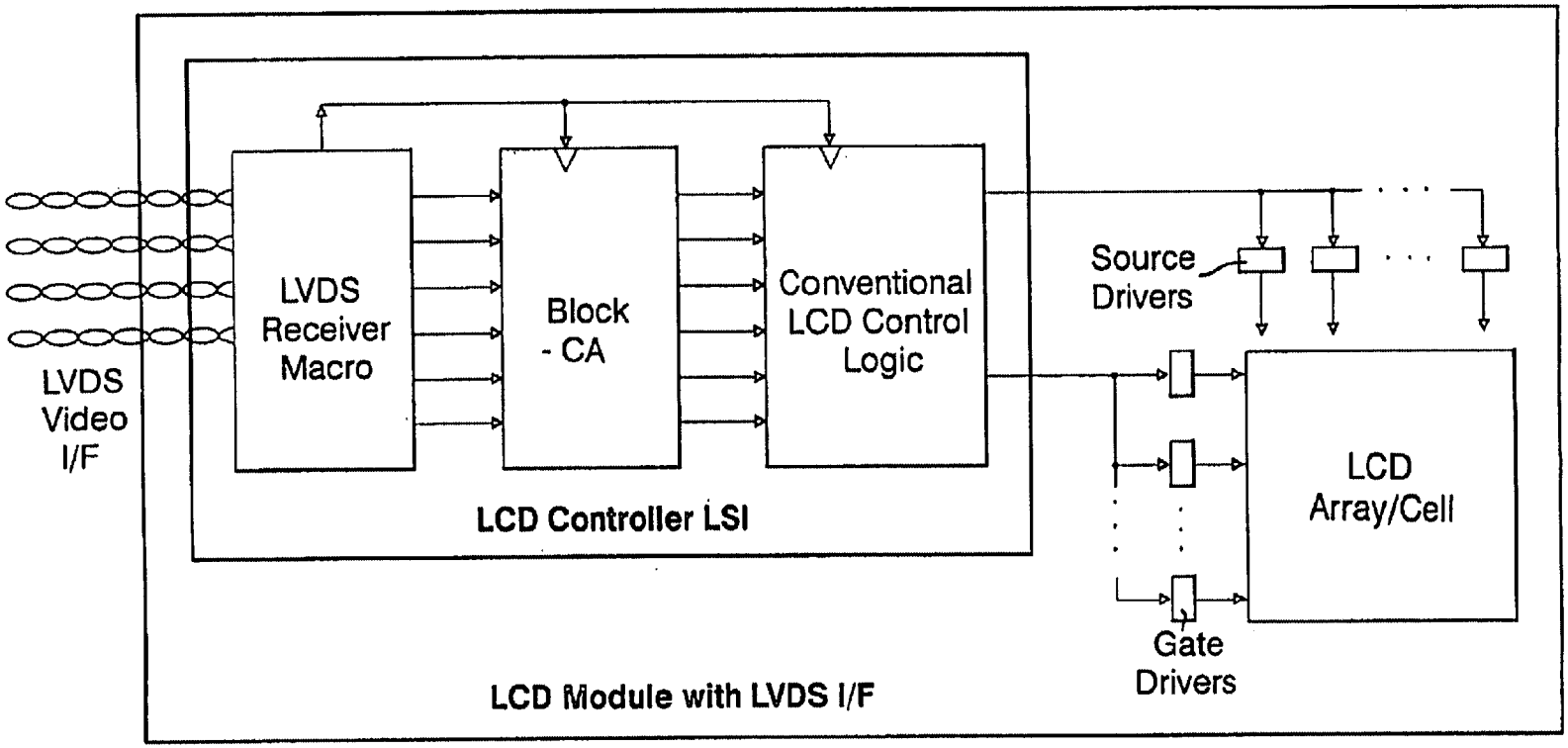
FIG. 7 shows the location of the color adjustment block in the digital color display device.

For example, supposing that the digital color display device is an LCD module of an LVDS video interface, the Block-CA is located between the LVDS receiver Macro and the conventional LCD Control Logic within the LCD Controller LSI, as shown in FIG. 7.

Figure 8:
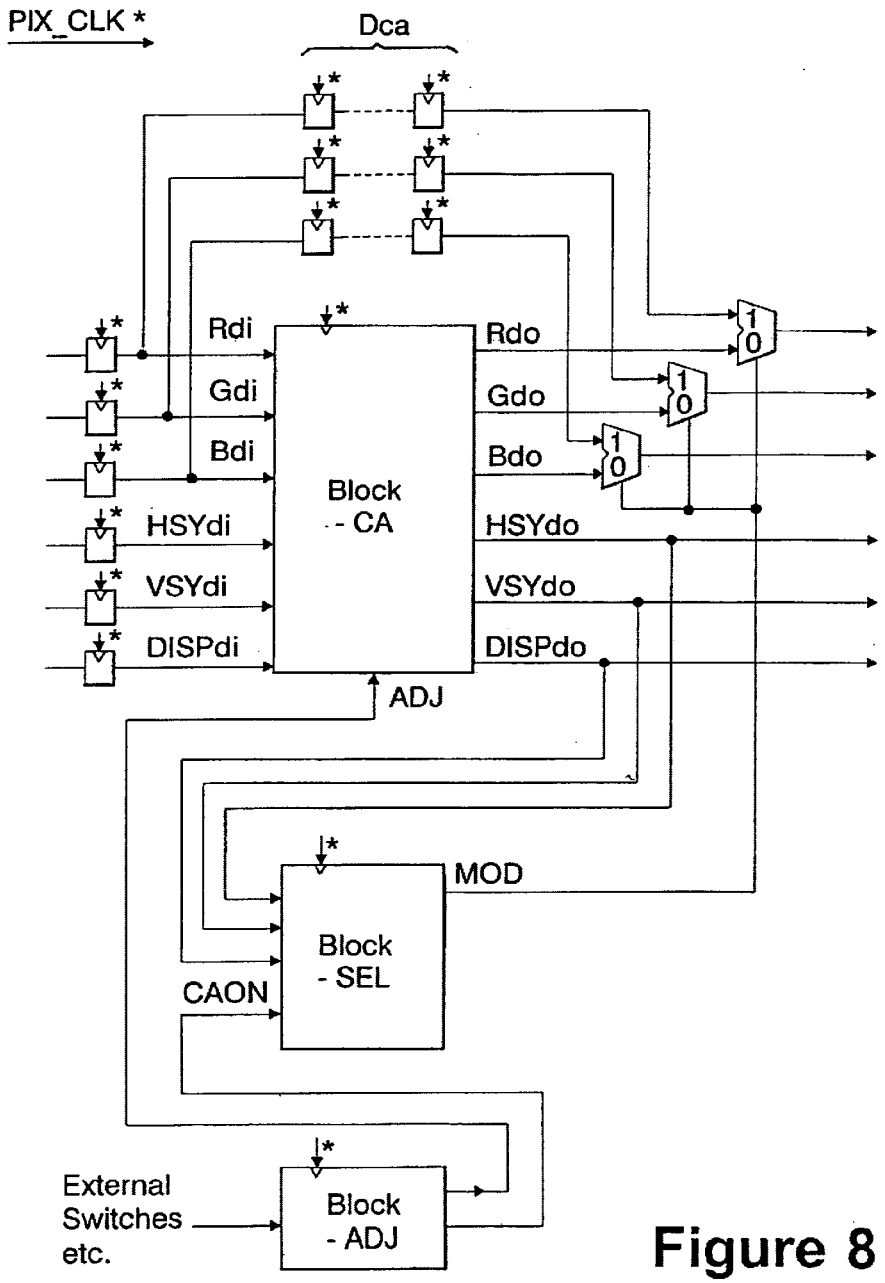
FIG. 8 shows an example of an overall configuration implementing the apparatus according to the present invention, using the color adjustment block in FIG. 5 as a part of it.

FIG. 8 shows an example of an overall configuration implementing the apparatus according to the present invention, using the color adjustment block in FIG. 5 as a part of it. In the example shown in FIG. 8, a Block-SEL inputs various synchronous signal inputs HSYdo, VSYdo, and DISPdo, and a signal CAON indicating that the color adjustment is now being performed, and outputs a selection signal MOD to multiplexers (MUXs) for selecting the color signal to be transmitted to a later stage. A Block-ADJ inputs signals from external input means (such as switches externally provided), and outputs the ADJ and CAON. As can be apparently seen from the example shown in FIG. 8, the determination whether to pass the color signals through the Block-CA to adjust the colors, or not to pass them through the Block-CA, and to delay them by the Dca to transmit them to the later stage, is made based on the MOD signals by the MUXs provided for each of Rdo, Gdo, and Bdo. Furthermore, it is provided that at the end of the color adjustment period, the selections of the MUXs are fixed by the MOD signals so that the color signals having passed the color adjustment block are transmitted to the display section of the later stage over the whole display area.

Figure 9:
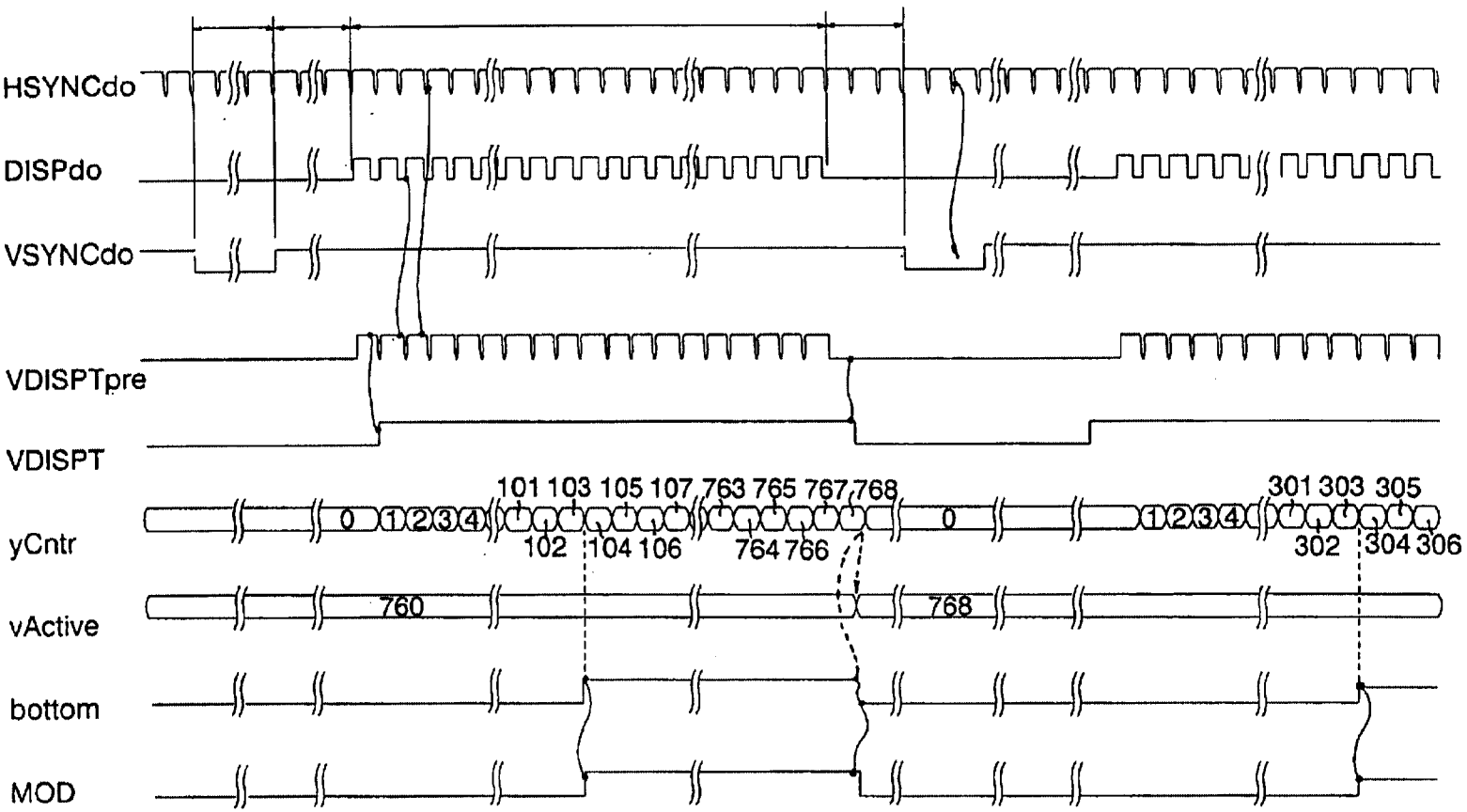
FIG. 9 shows an example of the timing diagram to be satisfied by the Block-SEL to provide the display screen shown in FIG. 1.
Figure 10:
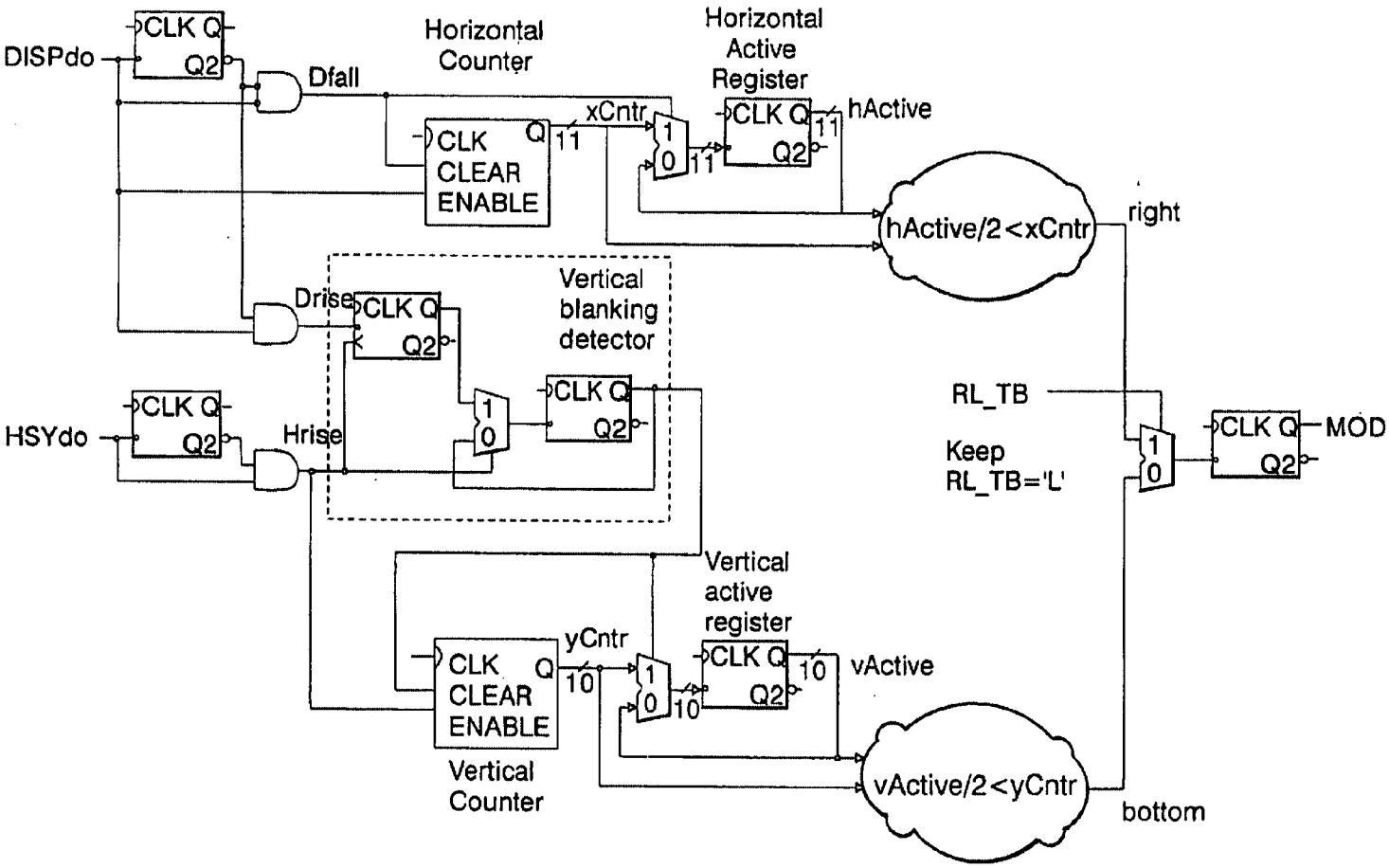
FIG. 10 shows an example of the configuration of a logic circuit for providing the timing shown in FIG. 9.
Figure 11:
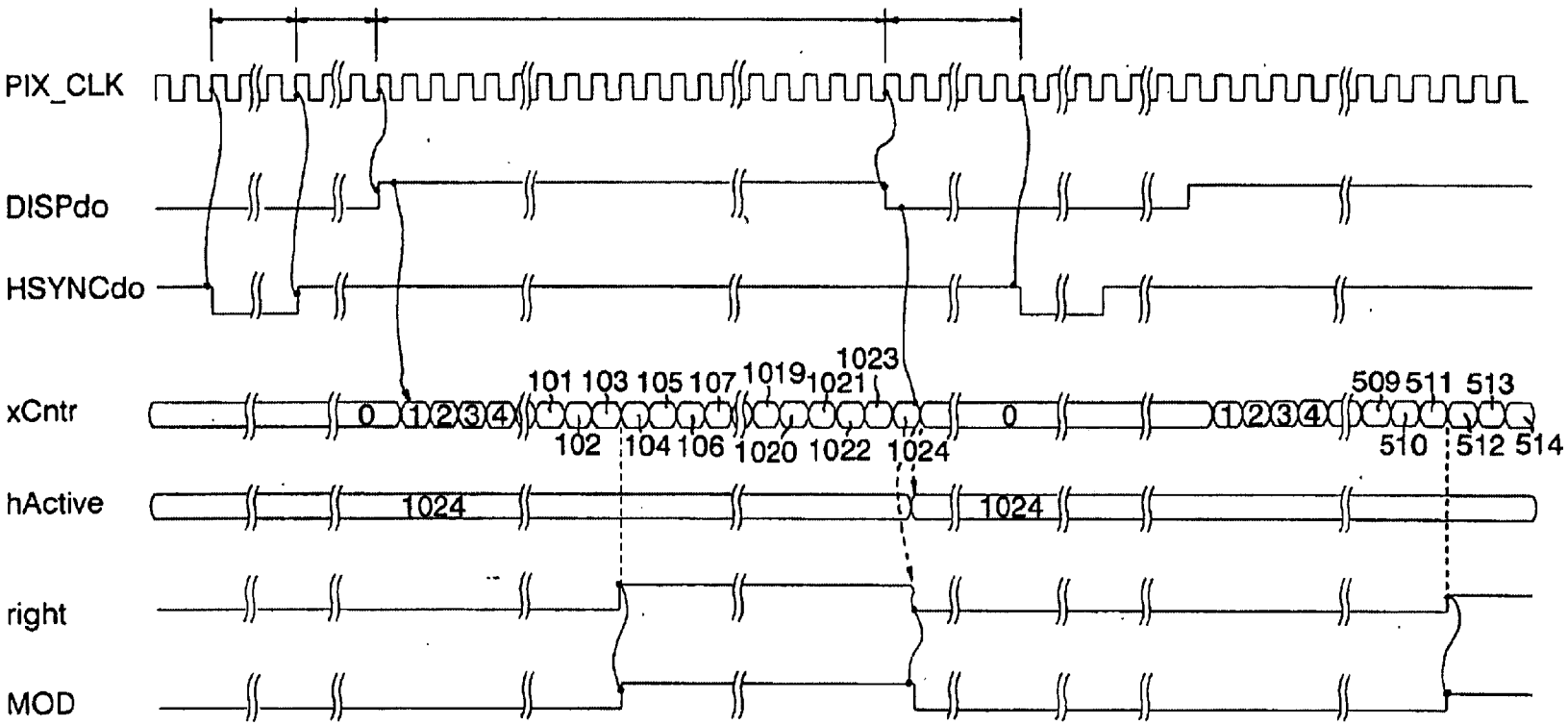
FIG. 11 shows an example of the timing diagram to be satisfied by the Block-SEL to provide the display screen shown in FIG. 2.
Figure 12:
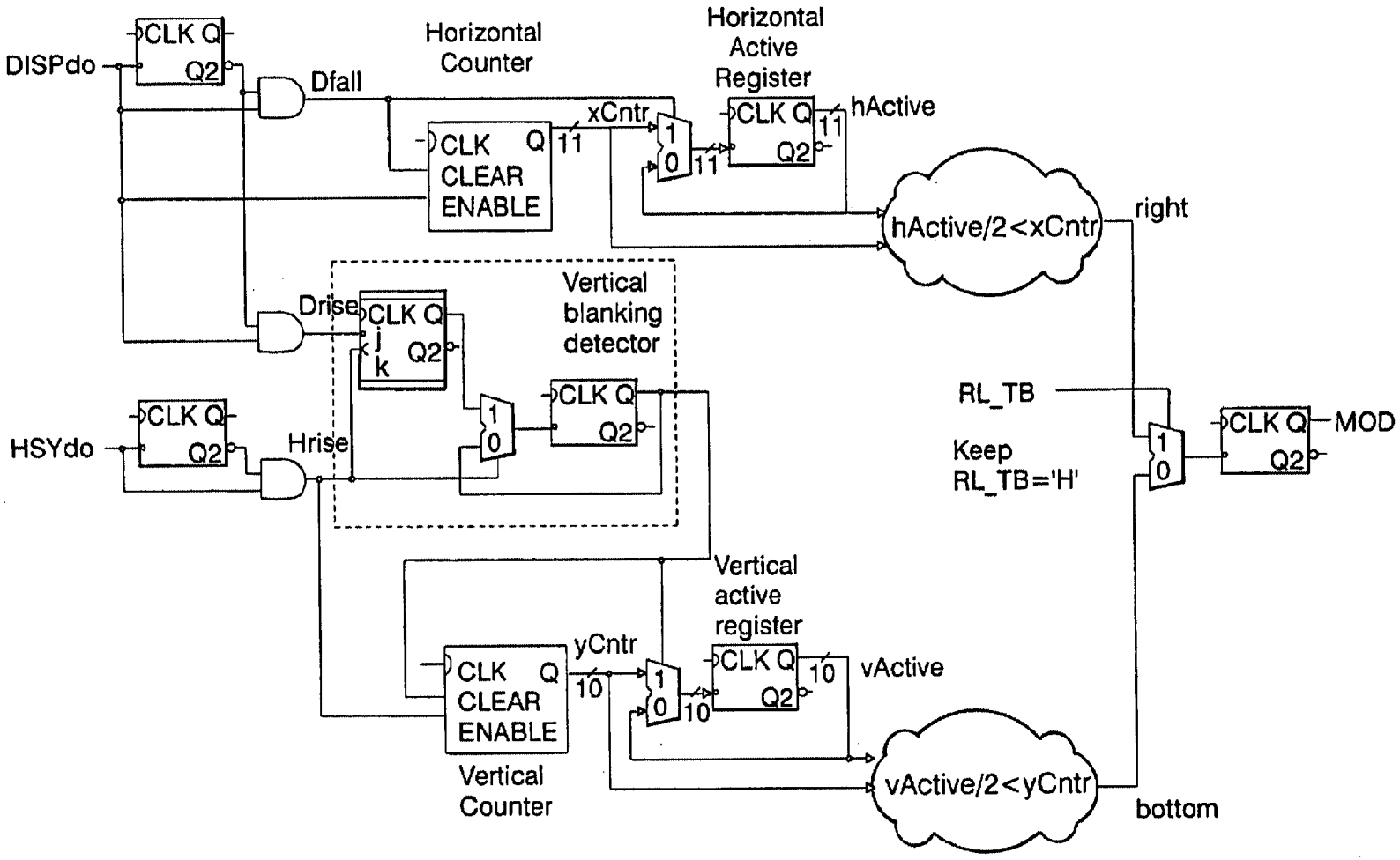
FIG. 12 shows an example of the configuration of a logic circuit for providing the timing shown in FIG. 11.

A timing diagram to be satisfied by the above-mentioned Block-SEL, and a configuration of a logic circuit for providing the timing will be now described. First, consider the case that, as shown in FIG. 1 described above, the display screen is divided into two parts, the top and bottom parts, and then a color image under the current color adjustment value is displayed in the top half, and a color image whose colors are not adjusted at all is displayed in the bottom half. Here, an example of the timing diagram to be satisfied by the Block-SEL is shown in FIG. 9. And an example of the configuration of a logic circuit for providing the timing is shown in FIG. 10. Next, consider the case that, as shown in FIG. 2 described above, the display screen is divided into two parts, the left and right parts, and then a color image under the current color adjustment value is displayed in the left half, and a color image whose colors are not adjusted at all is displayed in the right half. Here, an example of the timing diagram to be satisfied by the Block-SEL is shown in FIG. 11. And an example of the configuration of a logic circuit for providing the timing is shown in FIG. 12. As can be seen from the figures, the circuits shown in FIGS. 10 and 12 are the same circuit, in which the MUX of the later stage selects either "right" or "bottom" signal by means of a signal RL_TB. In the case of dividing into the top and bottom parts, as shown in FIG. 10, the signal RL_TB is fixed to L (low), and the signal "bottom" is selected. On the other hand, in the case of dividing into the left and right parts, as shown in FIG. 12, the signal RL_TB is fixed to H (high), and the signal "right" is selected.

While, in the examples described above, in the cases of dividing into the top and bottom parts, and of dividing into the left and right parts, the bottom part and right part, respectively, are specified as the display screen for the image without color adjustment, the present invention, of course, need not specify which part is to be the display screen for the image without color adjustment. And of course, the display screen is not necessarily divided into the top and bottom parts or into the left and right parts, and may be more irregularly divided.

As can be seen from the description described above, according to the present invention, when various kinds of color adjustments are performed in a color display device having a digital color signal flow section, along with the color image under the color adjustment value at that point in time, the color image whose colors are not adjusted at all is also displayed simultaneously in another area on the same display screen, so the users can adjust the colors efficiently and effectively without losing their objectivity. And this may be implemented by means of a relatively simple circuit.

While the invention has been particularly shown and described with respect to preferred embodiments thereof, it will be understood by those skilled in the art that the foregoing and other changes in form and details may be made therein without departing from the spirit and scope of the invention.

Having thus described our invention, what we claim as new, and desire to secure by Letters Patent is:

1. A method of adjustment a color of a display screen, comprised of:

displaying a moving color image wherein displayed patterns are varied in each frame without any color adjustment at a certain portion of the display screen;

simultaneously displaying a moving color image wherein displayed patterns are varied in each frame with a color adjustment at another portion of the display screen; and adjusting the moving color image with a color adjustment by referring to the color image without any color adjustment during a color adjustment period, wherein adjusted colors of the adjusted moving color image change in real time during said color adjustment period in response to a color adjusting operation by a user.

2. The method of adjusting a color of a display screen according to claim 1, wherein said color adjustment is any one of a tint adjustment, a white point adjustment, or a blue shift adjustment of achromatic colors.

3. The method of adjusting a color of a display screen according to claim 1, wherein the display screen is divided into two parts, the top and bottom parts, or the left and right parts, and the color image whose colors are not adjusted at all is displayed on one part of the display screen, and simultaneously the color image whose colors are adjusted is displayed on the other part of the display screen.

4. The method of adjusting a color of a display screen according to claim 1, wherein the display screen is divided into multiple display screens, the color image whose colors are not adjusted at all is displayed on one display screen, and simultaneously the color images whose colors are differently adjusted are displayed on the other display screens, respectively.

5. An apparatus for color adjustment of an image displayed on a display screen, said apparatus comprising:

color adjustment means for performing color adjustment by receiving color image signals comprising digital color data which are synchronized for input with a pixel clock and delaying by a certain clock cycle (Dca cycle) the digital color data, transforming said digital color data, and outputting said transformed digital color data in a pipeline manner, said color adjustment means including:

a counter device for monitoring and counting horizontal synchronous and vertical synchronous signals received with a color image frame and determining in which row and column within said color image frame an input color image signal is to be displayed, and during a color adjustment period, the counter values are utilized:

(1) to pass input color signals used to display a color image in a first-display area in the display screen trough the color adjustment means, and transmit the color signals delayed by the Dca cycle and transformed in the color adjustment means to said first display area; and (2) not to pass input color signals used to display said color image in another display area in the display screen through the color adjustment means, only delay them by the Dca cycle, and transmit them to the another display area, so that the color image whose colors are adjusted is displayed at the first display area of the display screen, and the color image whose colors are not adjusted at all is displayed at said another display area of the display screen.

6. The apparatus for color adjustment according to claim 5, further comprising means for switching between the transformed color image signals and said delayed color image signals of said cases (1) and (2), respectively, utilizing said counter values.

7. The apparatus for color adjustment according to claim 6, wherein said switching means includes multiplexor devices (MUXs) selected for transmitting of said transformed color image at the end of the color adjustment period, the selections of the MUXs being fixed so that the color image signals having passed the color adjustment block are transmitted to the first display area delayed by the Dca cycle.

* * * * *